US005437166A

United States Patent [19]

Gardner

[11] Patent Number: 5,437,166

[45] Date of Patent: Aug. 1, 1995

[54] EAR PIERCING STUDS

[76] Inventor: William J. Gardner, 16 Beaumaris Road, Newport, Shropshire TF10 7BN, United Kingdom

[21] Appl. No.: 135,674

[22] Filed: Oct. 13, 1993

[30] Foreign Application Priority Data

Oct. 16, 1992 [GB] United Kingdom ..... 9221736

[51] Int. Cl.[6] ..... A44C 7/00

[52] U.S. Cl. ..... 63/12; 604/222

[58] Field of Search ..... 63/12, 1.1; 604/222–227

[56] References Cited

U.S. PATENT DOCUMENTS

| | | | |
|---|---|---|---|
| 3,605,438 | 9/1971 | Chalson | 63/12 |
| 3,943,935 | 3/1976 | Cameron . | |
| 4,089,189 | 5/1978 | Verducci | 63/12 |
| 4,353,370 | 10/1982 | Evans . | |
| 4,510,772 | 4/1985 | Alley | 63/12 |
| 4,595,007 | 6/1986 | Mericle | 63/12 |
| 4,761,971 | 8/1988 | Freier | 63/12 |
| 4,774,817 | 10/1988 | Beam | 63/12 |
| 5,002,563 | 3/1991 | Pyka | 606/222 |

FOREIGN PATENT DOCUMENTS

| | | | |
|---|---|---|---|
| 2466210 | 4/1981 | France | 63/12 |
| 1117966 | 6/1968 | United Kingdom | 63/12 |
| 1504492 | 3/1978 | United Kingdom . | |
| 1542918 | 3/1979 | United Kingdom | 63/12 |
| 2187930 | 9/1987 | United Kingdom . | |
| 2189373 | 10/1987 | United Kingdom . | |
| 2241147 | 8/1991 | United Kingdom . | |
| 2244636 | 12/1991 | United Kingdom . | |
| WO8805273 | 7/1988 | WIPO . | |

*Primary Examiner*—Flemming Saether
*Attorney, Agent, or Firm*—Jones, Day, Reavis & Pogue

[57] ABSTRACT

An ear piercing stud comprises a machined piercing post of titanium or other metal suitable for being in contact with flesh, a stud head of material capable of being gold plated and a shield of a material suitable for being in contact with pierced flesh. The shield lies against the stud head where the post meets the stud head to shield flesh from contact with the stud head in use. The post, shield and stud head are made separately and are assembled with part of the post passing through the shield and engaged in the stud head to hold the post, shield and stud head permanently.

6 Claims, 1 Drawing Sheet

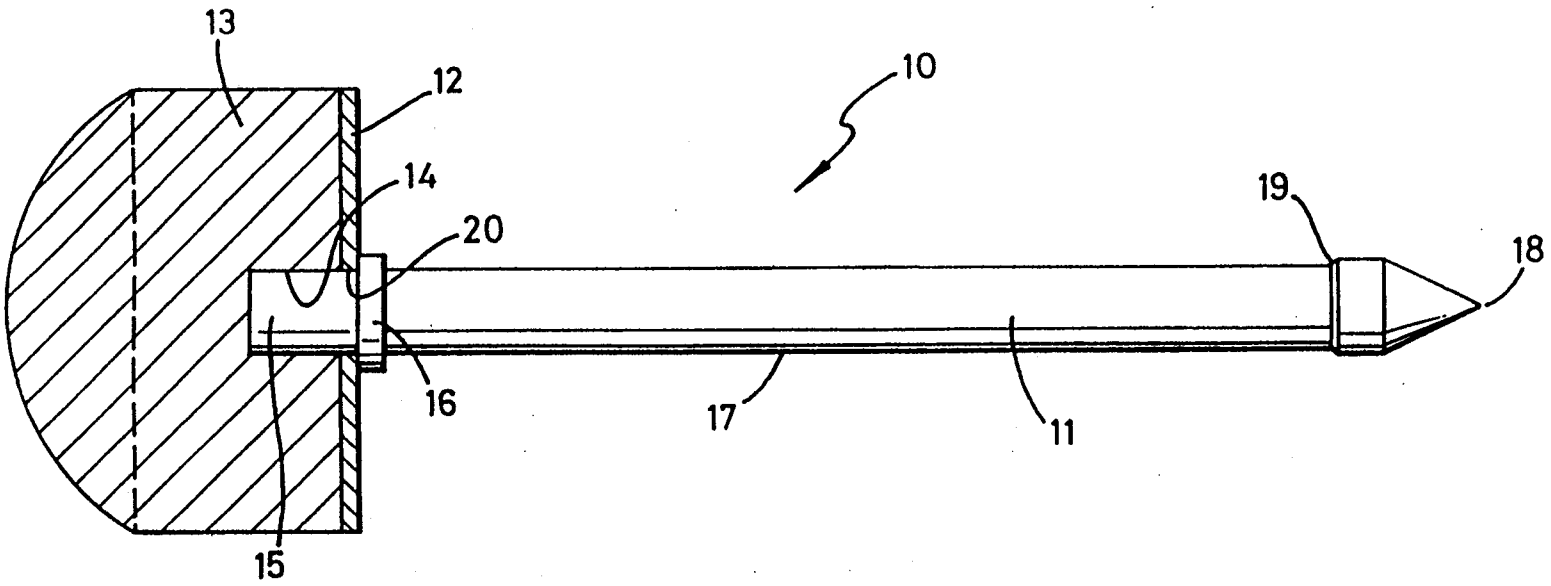
10
11
12
13
14
15
16
17
18
19
20

EAR PIERCING STUDS

FIELD OF THE INVENTION

The invention relates to ear piercing studs, this term herein referring to studs having a post and a stud head, the post having a point at the end remote from the head. Such ear piercing studs are usually driven through an ear lobe by an ear piercing instrument, and may act as a keeper, retained by a clasp engaging the post adjacent its free end. The term "ear piercing stud" covers studs for use in piercing other parts of the body such as the nose.

BACKGROUND OF THE INVENTION

Ear piercing studs are commonly made in one piece, turned from a metal such as stainless steel. The material of the stud is often plated to have a gold appearance. A material frequently used is stainless steel 303S21 which has good mechanical properties, but has 7% nickel content. Even when plated, it has been suggested that this level of nickel is unacceptably high. Studs with a plastics post have been proposed, for example in GB-A-2187930A, but plastics has disadvantages of its own such as the likelihood of surface imperfections in moulding, and the need for the post to be relatively thick to provide adequate strength. A metal post is thus desirable, and it is essential, if the stud is made in more than one part for the parts to be fixed together permanently.

One metal which is particularly suitable for the post, namely titanium, which can be of surgical grade and polished, has a problem that it is impossible to gold plate by conventional electroplating methods, and a gold plated finish for the visible stud head is the most commonly requested finish.

SUMMARY OF THE INVENTION

The object of this invention is to provide an improved ear piercing stud with a post of precision machined and highly polished, surgical grade titanium, but which has a gold plated stud head, and in which material of the stud head is kept out of contact with flesh.

According to the invention, there is provided an ear piercing stud comprising a precision machined and polished piercing post of surgical grade titanium, a stud head of a material capable of being gold plated, and an annular shield of a material suitable for being in contact with pierced flesh, the shield lying against the stud head where the post meets the stud head to shield flesh from contact with the stud head in use, the post shield and stud head being made separately and assembled with part of the post passing through the shield and engaged in the stud head to hold the post, shield and stud head together permanently.

It will be appreciated that the parts of the assembled stud could be separated if sufficient force is applied; the term "permanently" is to be understood as referring to the fact that the stud is not intended or designed to be taken apart.

The stud head preferably has a recess for engagement by the post with a friction fit. The post preferably has a shoulder for retaining the shield against the stud head.

The shield is preferably of titanium, but other materials such as plastics may be used. It is less important for the shield to have structural strength than is the case for the post.

The head is preferably brass, and preferably gold plated.

BRIEF DESCRIPTION OF THE DRAWING

By way of example, one embodiment of an ear piercing stud according to the invention will now be described with reference to the accompanying drawing, which is a sectional side view of an ear piercing stud.

DESCRIPTION OF PREFERRED EMBODIMENT

A stud 10 has three separately formed elements, namely a post 11 machined from surgical grade titanium, and polished to a mirror finish to remove surface imperfections, an annular shield 12 also of surgical grade titanium suitably finished, and a brass stud head 13, preferably gold plated.

The stud head 13 is formed with a cylindrical recess 14 and the post 11 is formed with a cylindrical spigot 15 dimensioned to engage the recess 14 with a friction fit. The spigot 15 is of the same diameter as a shaft portion 17 of the post. The post has an annular shoulder 16 of external diameter larger than both the external diameter of the spigot and the shaft portion 17 of the post 11. The post 11 has a point 18 at its free end, and an annular step 19 for engagement by a back clasp (not shown) in conventional manner.

The shield 12 has a central hole 20 through which the spigot 15 passes, the shoulder 16 holding the shield 12 against the stud head 13.

It will be appreciated that the shield 12 can be of materials other than titanium, provided the materials exhibit satisfactory characteristics and are safe to be against pierced flesh avoiding contact nickel dermatitis.

Similarly, the material of the stud head may be different from brass, and may have different finishes. The particular advantage of this embodiment is that the stud head can be finished as desired, without concern about the material of the stud head contacting pierced flesh because of the protection afforded by the shield. The material of the stud head can be inexpensive. Above all, this embodiment solves the problem of having a viable stud with a titanium post, and represents a significant improvement in ear piercing studs.

It will be appreciated that the foregoing description is by way of example only, and that modifications and alterations may be made within the scope of the invention as defined in the appended claims.

I claim:

1. An ear piercing stud comprising a precision machined and polished piercing post of surgical grade titanium, a stud head of a material capable of being gold plated, and an annular shield of a material suitable for being in contact with pierced flesh, the post having a pointed end remote from the stud head to facilitate flesh piercing when the stud is driven through flesh in a piercing operation, the stud head and the post having coincident longitudinal axes, the shield lying against the stud head where the post meets the stud head to shield flesh from contact with the stud head in use, said stud head having a closed recess therein, the post, the annular shield and the stud head being made separately and assembled with a shoulder defining a spigot end portion of reduced diameter with respect to the shoulder which through the annular shield and engaged in the recess in the stud head such that the shoulder holds the annular shield and the stud head permanently together.

2. An ear piercing stud as claimed in claim 1 wherein the stud head is engaged by the post with a friction fit.

3. An ear piercing stud as claimed in claim 1 wherein the shield is of titanium.

4. An ear piercing stud as claimed in claim 1 wherein the stud head is of brass.

5. An ear piercing stud as claimed in claim 4 wherein the stud head is gold plated.

6. An ear piercing stud comprising a precision machined and polished piercing post of titanium, a stud head of gold-plated brass and a shield of titanium, the post having a pointed end remote from the stud head to facilitate flesh piercing when the stud is driven through flesh in a piercing operation, the stud head and the post having coincident longitudinal axes, the shield lying against the stud head where the post meets the stud head to shield flesh from contact with the stud head in use, the post, the shield and the stud head being made separately and assembled with an unpointed end of the post passing through the shield and engaged in the stud head to hold the post, the shield and the stud head permanently together, the stud head having a closed recess therein engaged by the unpointed end of the post with a friction fit and the post having a shoulder with a diameter larger than said post for retaining the shield against the stud head.

* * * * *